US006864899B1

(12) United States Patent
Barrus et al.

(10) Patent No.: US 6,864,899 B1
(45) Date of Patent: Mar. 8, 2005

(54) EFFICIENT CLIP-LIST MANAGEMENT FOR A TWO-DIMENSIONAL GRAPHICS SUBSYSTEM

(75) Inventors: Frank E. Barrus, New Ipswich, NH (US); Lawrence R. Rau, Dublin, NH (US); Craig F. Newell, Lowell, MA (US)

(73) Assignee: Savaje Technologies, Inc., Chelmsford, MA (US)

( * ) Notice: Subject to any disclaimer, the term of this patent is extended or adjusted under 35 U.S.C. 154(b) by 92 days.

(21) Appl. No.: 10/287,862

(22) Filed: Nov. 4, 2002

(51) Int. Cl.[7] ..... G09G 5/00; G09G 5/397

(52) U.S. Cl. ..... 345/620; 345/623; 345/628; 345/713; 345/530; 345/545

(58) Field of Search ..... 345/418, 422, 345/581, 628, 629, 623, 624, 654, 665, 630, 650, 680, 700, 713, 797, 806, 804–805, 530, 531, 545, 547–548, 620, 764, 759, 783, 539, 538

(56) References Cited

U.S. PATENT DOCUMENTS

| | | | | | |
|---|---|---|---|---|---|
| 5,553,210 | A | * | 9/1996 | Narayanaswami | 345/628 |
| 5,689,665 | A | | 11/1997 | Mitsui et al. | |
| 5,768,491 | A | * | 6/1998 | Lobodzinski et al. | 345/620 |
| 2002/0103974 | A1 | * | 8/2002 | Giacomini et al. | 711/133 |
| 2002/0174201 | A1 | * | 11/2002 | Ramer et al. | 709/220 |
| 2003/0126299 | A1 | * | 7/2003 | Shah-Heydari | 709/252 |

* cited by examiner

*Primary Examiner*—Matthew C. Bella
*Assistant Examiner*—Wesner Sajous
(74) *Attorney, Agent, or Firm*—Hamilton, Brook, Smith & Reynolds, P.C.

(57) ABSTRACT

A graphics sub-system manages a two-dimensional coordinate space which includes a plurality of rectangular regions. The two-dimensional coordinate space is represented by a hierarchical linked list of nodes. Each node represents a rectangular region of two-dimensional coordinate space. Each node acts as a bounding box for all descendant nodes in the hierarchical linked list of nodes.

15 Claims, 8 Drawing Sheets

EFFICIENT CLIP-LIST MANAGEMENT FOR A TWO-DIMENSIONAL GRAPHICS SUBSYSTEM

BACKGROUND OF THE INVENTION

In a user interface having a plurality of windows some windows can overlap each other. When rendering a primitive such as a line in one of the rectangular windows the line is clipped to a clip region; that is, a visible region in the rectangular window. One method for clipping the line to the visible region is to compute the intersections of the line with the visible region.

A depth sort algorithm also known as the painter's algorithm can be used to determine the correct order of display. The painter's algorithm renders objects such that the order of display is dependent on distance from the viewing point with the furthest away objects being rendered first. The algorithm renders objects similar to a painter who paints the background first and then adds objects to the foreground.

The algorithm requires a double buffered frame buffer, that is, the image is rendered in a first frame buffer and then copied to a second frame buffer memory from which the image is displayed by the display device. Thus, each window is written to the first frame buffer from back to front with overlapping portions of foreground windows overwriting background windows until the first frame buffer only stores visible regions of the overlapped windows.

SUMMARY OF THE INVENTION

In general, personal handheld devices having a limited memory such as, mobile phones, Personal Data Assistants (PDA) and web terminals do not have sufficient memory for a double buffered frame buffer. However, users expect the same rendering performance as obtained in systems having a double-buffered frame buffer.

A method for managing a single on-screen buffer is provided by the present invention. A two-dimensional co-ordinate space is represented by a hierarchical linked list of nodes. Each node represents a rectangular region of the two-dimensional coordinate space. The rectangular region of a parent node acts as a bounding box for all descendant nodes. A screen buffer manager determines a region of a screen buffer to be updated by traversing the hierarchical linked list for nodes representing respective rectangular regions intersecting a desired update area.

Each node has a respective node identifier which may be stored in a single cache line. The node identifier identifies (i) the rectangular region represented by the node, (ii) a next node, (iii) a skip node, (iv) a previous node and (v) a parent node associated with the node in the hierarchical linked list of nodes. The rectangular region may be a window.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
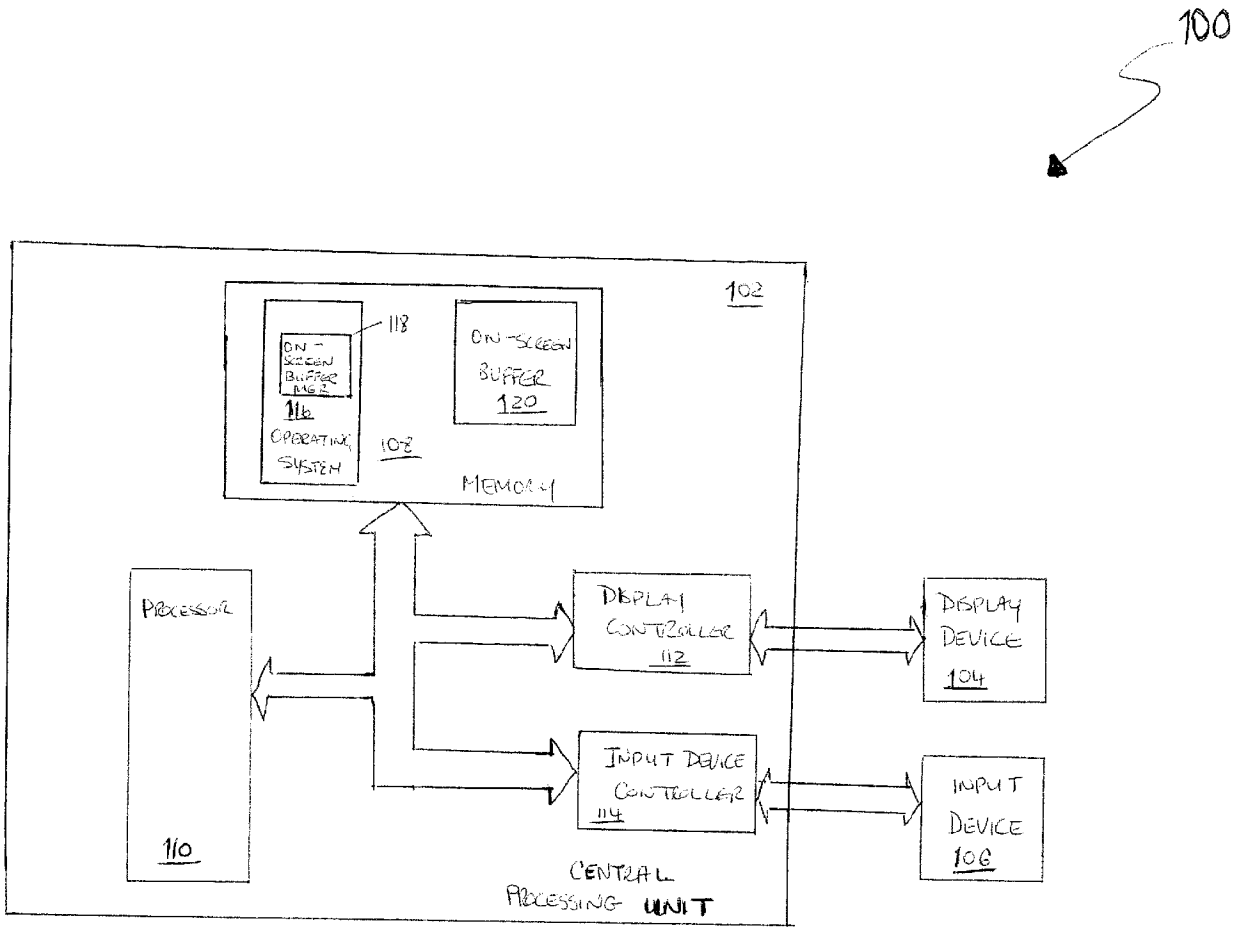
FIG. 1 is a block diagram of a computer system including an on-screen buffer managed by an on-screen buffer manager according to the principles of the present invention.

FIG. 1 is a block diagram of a computer system 100 including an on-screen buffer 120 managed by an on-screen buffer manager 118 according to the principles of the present invention. The computer system 100 includes a central processing unit 102 coupled to a display device 104 and an input device 106. The display device 104 includes a screen for displaying a two-dimensional array of pixels representing the contents of the on-screen buffer 120. The screen can be a flat panel screen, a Cathode Ray Tube (CRT), a Liquid Crystal Display (LCD) or any other type of screen typically used by a display device.

A portion of the memory 108 is reserved for the on-screen buffer 120. The on-screen buffer manager 118 in an operating system 116 in the memory 108 manages updates to the on-screen buffer 120. In the embodiment shown, a portion of the memory 108 is reserved for the on-screen buffer 108. However, in alternate embodiments, the on-screen buffer 120 can be a separate memory.

A processor 110 is coupled to the memory 108, a display controller 112 and an input device controller 114. The display controller 112 coupled to the display device 104 reads the on-screen buffer 120 for display by the display device 104. The processor is also coupled to an input device controller 114 for processing keycodes received from an input device 106 coupled to the input device controller 114. The input device 106 can be a keyboard, keypad, mouse or any other type of input device typically used in a computer system.

In one embodiment the processor 110 is an Intel StrongARM Reduced Instruction Set Computer (RISC) processor which includes data cache and instruction cache. The instruction cache and data cache increases the performance of the computer system 100 by reducing the number of accesses to the memory 108.

Figure 2:
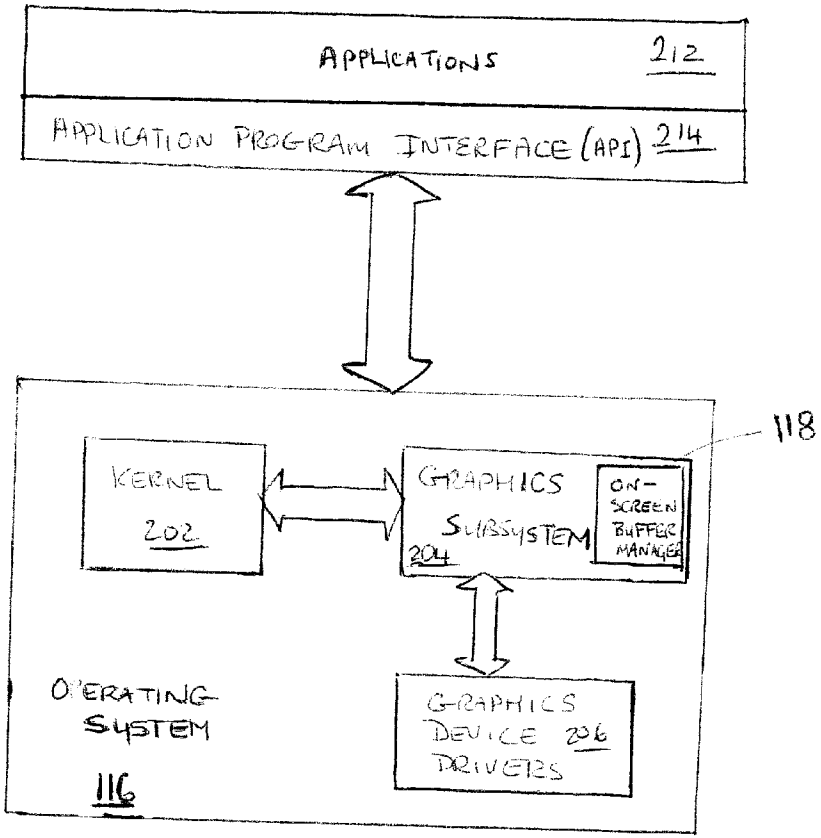
FIG. 2 is a block diagram of an operating system including the on-screen buffer manager in the computer system shown in FIG. 1.

FIG. 2 is a block diagram of the operating system 116 including the on-screen buffer manager 118 shown in FIG.

1. The operating system 116 also includes a kernel 202, graphics subsystem 204 and graphics device drivers 206. An application 212 calls the operating system 116 through an Applications Program Interface (API) 214. The application program can be an object oriented application, for example, a JAVA application.

The type of display device coupled to the computer system 100 is hidden from the application 212 by the operating system 116. Each graphics device driver 206 includes functions to support a particular type of display device 104.

The graphics subsystem 204 includes the on-screen buffer manager 118 for managing the on-screen buffer 120 in memory 108. The on-screen buffer 120 corresponds to the two dimensional co-ordinate system of the screen by the display device 104 and is continuously read by the display controller 112 for display on the screen of the display device 104. All updates to the data displayed on the screen of the display device 104 are performed directly in the on-screen buffer 120 while the on-screen buffer 120 continues to be read for display on the screen. The on-screen buffer manager 118 efficiently updates the on-screen buffer 120 by representing the on-screen buffer 120 as a hierarchical linked list of nodes which can be quickly searched to determine one or more rectangular regions to be updated.

A graphics command (for example, a draw line command) issued to the operating system 116 through the API 214 is directed to the graphics subsystem 204 in the operating system 116. The graphics command is typically directed to a rectangular region (A) of the screen known to the application. However, the rectangular region (A) may be covered by another rectangular region (B) known to another application. Thus, only a portion of the rectangular region (A) to be updated by the graphics command may be actually displayed on the screen and stored in the on-screen buffer 120. The portion of the rectangular region (A) known to the application stored in the on-screen buffer 120 can be referred to as a visible rectangular region (C) of the rectangular region (A). The hierarchical list of nodes can be quickly searched to determine the visible rectangular region (C) of the application's rectangular region (A) to be updated in the on screen buffer 120 in response to the graphics command.

Figure 3C:
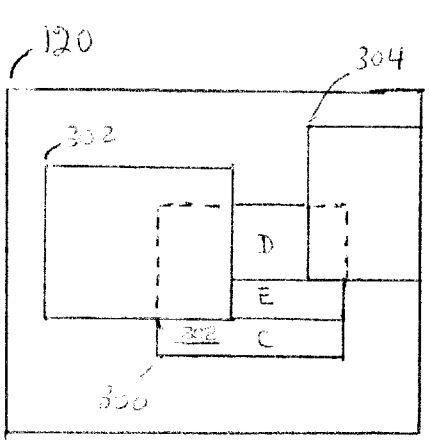
FIG. 3C illustrates the addition of a third rectangular region which overlaps the first rectangular region as displayed by the display device.
Figure 3B:
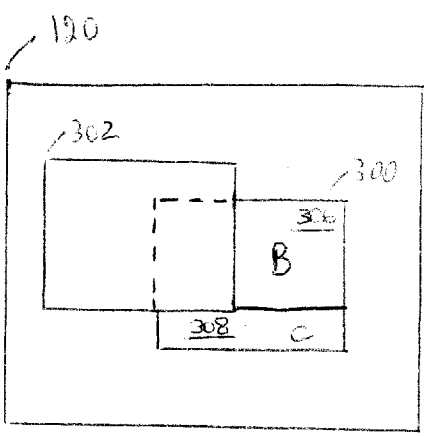
FIG. 3B illustrates the addition of a second rectangular region which overlaps the first rectangular region as displayed by the display device.
Figure 3A:
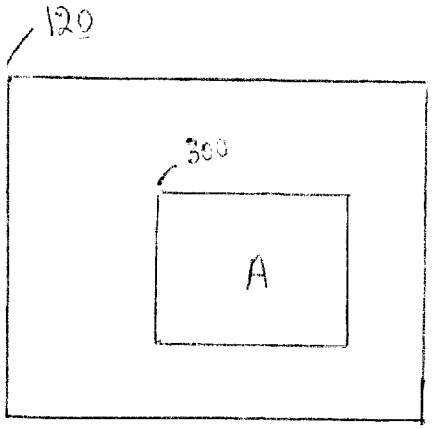
FIG. 3A illustrates a rectangular region defined in the on-screen buffer as displayed by the display device shown in FIG. 2.

FIG. 3A illustrates a rectangular region 300 in the on-screen buffer 120 and displayed by the display device 104 shown in FIG. 1. In one embodiment, rectangular region 300, labeled A, can be a window. In alternate embodiments, rectangular region 300 can be a drawing region. All of rectangular region 300 is stored in the on-screen buffer 120 for display by the display device 104.

FIG. 3B illustrates the on-screen buffer 120 after a second rectangular region 302 which overlaps rectangular region 300 is added. Thus, a portion of the first rectangular region 300 is covered by the second rectangular region 302. The visible area of the first rectangular region 300 can be subdivided horizontally (or vertically) into two rectangular regions 306, 308, labeled B and C. Region B and region C do not intersect and are fully contained within region A. Thus, region B and Region C can be considered children of region 300 and can be linked to a parent node representing region 300.

FIG. 3C illustrates the on-screen buffer 120 after a third rectangular region 304 which overlaps the first rectangular region 300 is added. The visible area of region 300 is further reduced by the addition of the third region 304 which overlaps region B of region 300. Region B is sub-divided horizontally (or vertically) into two rectangular regions labeled D and E to identify the visible area of region 300 stored in the on-screen buffer 120. The two new regions, region D and region E are descendants of region 300 and children of region B in the linked list of nodes.

After the further sub-division of region 300 into three visible rectangular regions labeled D, E and C, regions D, E and C can be represented as leaf nodes of the hierarchical linked list. The leaf nodes are descendants of rectangular region A (first rectangular region 300) and identify the visible regions of rectangular region A.

The subdividing of rectangular regions into smaller rectangular regions described in conjunction with FIGS. 3A–3C is performed by subdividing each parent rectangular region horizontally. In an alternate embodiment, the subdividing can be performed by subdividing each rectangular region vertically. The decision as to whether to subdivide horizontally or vertically is dependent on which method of rendering is more optimal for a particular organization of the memory 108 in the computer system 100.

Figure 4:
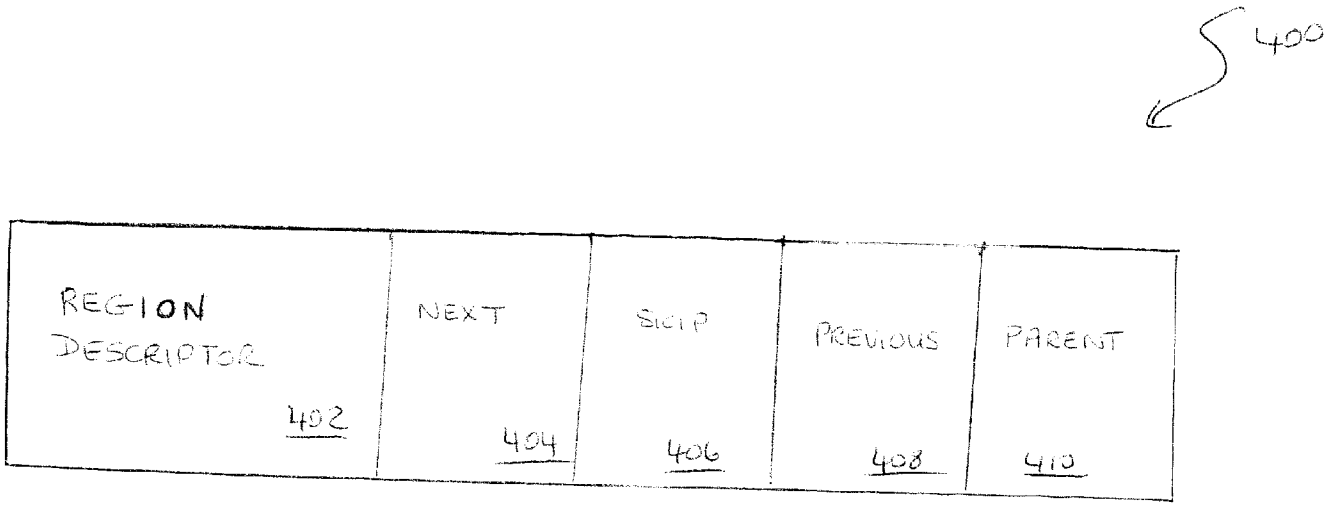
FIG. 4 is a block diagram of a node descriptor in the hierarchical linked list maintained by the on-screen buffer manager.

FIG. 4 is a block diagram of a node descriptor 400 in the hierarchical linked list maintained by the on-screen buffer manager 118. Each node descriptor 400 includes a region descriptor 402, a next field 404, skip field 406, a previous field 408 and a parent field 410. The region descriptor 402 describes a rectangular region corresponding to anode in terms of two dimensional co-ordinates. The two dimensional co-ordinates correspond to two-dimensional co-ordinates on the screen of the display device 104. The region descriptor 402 is described in more detail later in conjunction with FIG. 5. The next, skip, previous and parent fields in a current node can store pointers to other nodes to link the current node to the other nodes in the hierarchical linked list of nodes.

The next field 404 can store a pointer to a next node in the hierarchical linked list of nodes. The next node pointer is selected such that by following the next node field 404 of each node descriptor 400 in the hierarchical linked list of nodes, all nodes in the linked list are traversed. The next node field 404 in the last node in the linked list of nodes stores the null pointer to indicate that it is the last node in the hierarchical linked list.

The skip field 406 stores a pointer to a node which does not intersect with the current node. The skip field 406 in the last node in the linked list stores a null pointer. In an embodiment in which the skip field 406 stores a pointer to a node at the same level in the linked list and the next field 404 stores a pointer to a child node, the skip field 406 stores a null pointer in node descriptors 400 of all the right-most nodes at the same level as the current node. The previous field 408 in a node descriptor 400 for the current node stores a pointer to a node in which the next field 404 in that node's descriptor 400 stores a pointer to the current node. The previous field 408 in the root node for the linked list stores a null pointer. The parent field 410 in the node descriptor 400 for a current node stores a pointer to a parent node. The rectangular region corresponding to the parent node acts as the bounding box for the current node. The parent field 410 for the root node stores a null pointer.

In one embodiment, the size of the node descriptor 400 is eight words. The size of the rectangular region descriptor 402 is 4 words and the size of each pointer field 404, 406, 408, 410 is one word. The eight 32 bit word node descriptor 400 fits precisely into a single 32 byte (eight 32-bit word) cache line in the processor's data cache. In an alternate embodiment having a different cache line size, the size of the node descriptor 400 can be modified to fit into the single cache line in the processor architecture. A node descriptor 400 which fits in a single cache line in a processor allows a quick search through nodes in order to efficiently render in the on-screen buffer 120. This matching of node descriptor 400 length to cache-line size adds efficiencies hereto for unachieved by the prior art.

Figure 5:
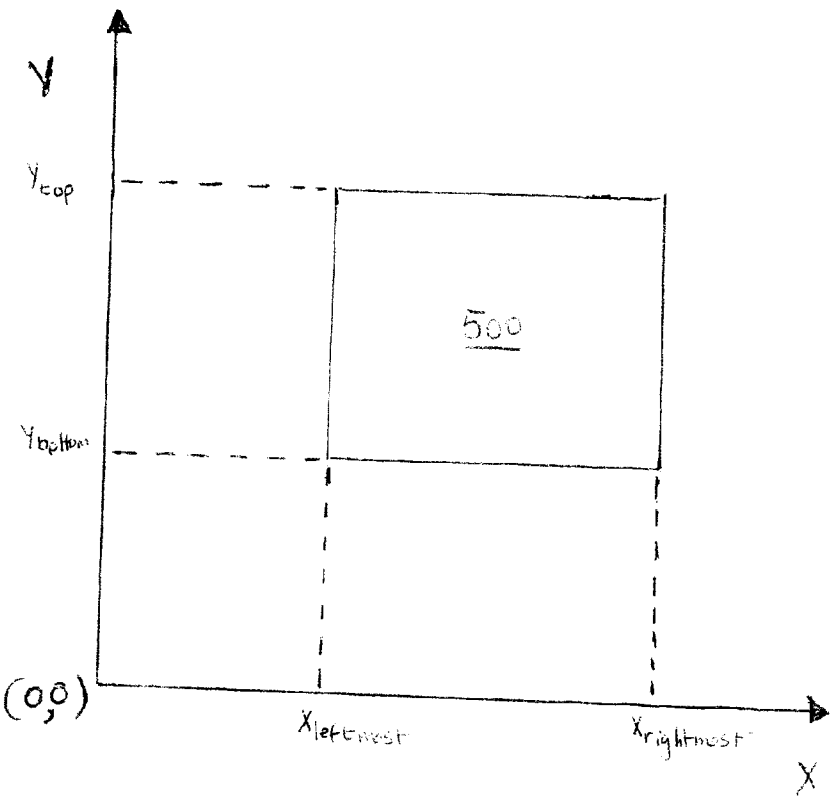
FIG. 5 illustrates a rectangular region defined by a region descriptor in the node descriptor shown in FIG. 4.

FIG. 5 illustrates a rectangular region 500 in a two dimensional coordinate space defined by a region descriptor 402 in the node descriptor 400 shown in FIG. 4. The rectangular region 500 can be defined by four co-ordinates in the two-dimensional (x, y) co-ordinate space. The leftmost x coordinate, the rightmost x coordinate, the top (uppermost) y coordinate and the bottom (lowermost) y coordinate.

The region descriptor 402 in the node descriptor 400 stores four coordinates as follows: x1: the leftmost x coordinate contained in the clipping rectangular region; x2: one greater than the rightmost x coordinate; y1: the topmost y coordinate contained in the clipping rectangle and y2: one greater than the bottommost y coordinate. Each coordinate is stored as one word supporting a coordinate space from (0, 0) to ($2^{31}$, $2^{31}$).

Typical display devices only use a portion of the available coordinate space. For example, common dimensions of display devices are 640×480 pixels or 800×600 pixels. In one embodiment for a 640×480 pixel screen, the graphics subsystem defines the coordinate space of the screen such that the pixel in the top leftmost corner of the screen is (0, 0) and the pixel at the bottom for the rightmost corner of the screen is (640, 480). However, it is not necessary for the screen co-ordinate space origin to include the 2D coordinate system origin (0, 0). Any portion of the co-ordinate system can be used to define the co-ordinate space represented by the on-screen buffer 120. The entire rectangular region defined by an application can be stored in the on-buffer screen or only a rectangular area (portion) of the rectangular region may be stored.

Figure 6:
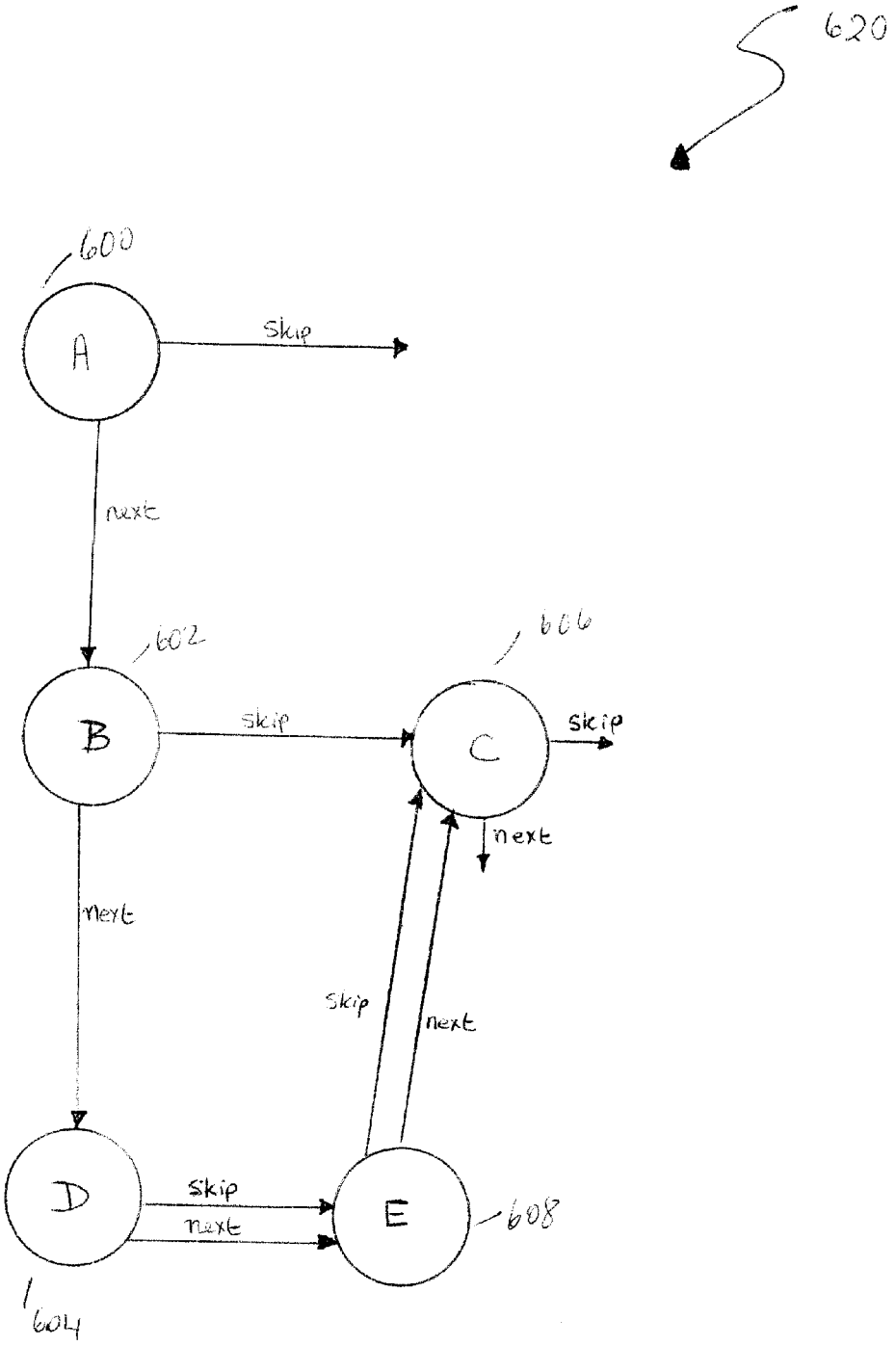
FIG. 6 illustrates the hierarchical linked list for the regions shown in FIG. 3C.

FIG. 6 illustrates the hierarchical linked list 620 of nodes representing rectangular regions 300, 302, 304 and C, D, E shown in FIG. 3C. The hierarchical linked list 620 is essentially a tree structure, with the leaf nodes representing rectangular regions visible on the screen and stored in the on-screen buffer 120. The interior nodes represent bounding rectangular regions of the portion of the tree beneath them. Each leaf node has respective identical next and skip fields 404, 406. The next field 404 of an interior node points to the first child (whose parent field 410 will point back). The skip field 406 of an interior node points to the next node whose rectangular region does not intersect the current interior node.

The hierarchical linked list 620 allows fast searching of complicated regions. Full traversal of the hierarchical linked list 620 involves iterating through the next fields 404 of each node in the linked list and ignoring nodes whose next and skip fields 404, 406 are not identical (i.e. ignoring non-leaf nodes). Selective traversal of a select area is similar to full traversal except that every time a node's rectangular region does not intersect the desired screen area of interest, the skip field 406 is followed instead of the next field 404.

Nodes are added to the hierarchical linked list 620 such that a parent node is a bounding box and fully contains display regions of its children nodes and no two siblings may have corresponding display regions that overlap. The first node is always a single parent for the entire list and its next and skip fields are equal. An only child is not allowed. Thus, every level of the tree represented by the hierarchical linked list is at least binary. A parent's bounding box fully contains all of its descendants beyond the immediate children and no rectangles may intersect without being fully contained.

The on-screen buffer manager 118 manages a hierarchical linked list of nodes representing rectangular regions in the on-screen buffer 120. Each node in the linked list represents a rectangular region of the on-screen buffer 120. To update the on-screen buffer 120, the on-screen buffer manager 118 determines which regions in the on-screen buffer are to be updated by traversing nodes in the hierarchical linked list to the leaf nodes. Having found the leaf node, the on-screen buffer manager 118 determines which of the rectangular regions corresponding to the leaf nodes intersect the desired update region. The leaf nodes correspond to rectangular regions in the on-screen buffer 120. Interior nodes in the hierarchical linked list include descendant leaf nodes. Only rectangular regions corresponding to leaf nodes in the hierarchical linked list are visible on the screen and are stored in the on-screen memory buffer 120. Thus, rectangular regions to be updated can be quickly determined by traversing the hierarchical linked list to reach the leaf nodes and selecting one or more leaf nodes to be updated based on the desired update region. The skip field 406 and next field 404 for each node descriptor 400 is shown in FIG. 6. The first node 600 describes region A as shown at 300 in FIG. 3A. The region descriptor 402 for node 600 stores coordinates of the rectangular region labeled A as described in conjunction with FIG. 5. The skip field 406 stores the null pointer because rectangular region A is a root node in the hierarchical linked list 620 of nodes.

Node 602 corresponds to rectangular region B as shown at 306 in FIG. 3B. In FIG. 6, Node 602 is a child of node 600 because rectangular region B is bounded by rectangular region 300. Node 602 is added to the linked list 620 by storing a pointer to the node descriptor 400 for rectangular region B in the next field 404 of the node descriptor 400 for region A.

Continuing with FIG. 6, node 606 corresponds to rectangular region C as shown at 308 in FIG. 3B. Node 606 is also a child of node 600 because rectangular region C is bounded by region A (FIG. 3A). Node 606 is also a sibling of node 602 because region B and region C do not overlap (FIG. 3B). Therefore, node 606 in FIG. 6 is added to the hierarchical linked list 620 of nodes by storing a pointer to the node descriptor for region C in the skip field 406 of the node descriptor 400 for node 602.

Node 604 corresponds to region D as shown in FIG. 3C. Node 604 is, a child of node 602. Node 604 is added to the hierarchical linked list 620 by storing a pointer to the node descriptor 400 for region D in the next field 404 of the node descriptor for region B.

Node 608 corresponds to region E as shown in FIG. 3C. Node 608 is also a child of node 602 because rectangular region E lies within the bounds of rectangular region B (FIG. 3B). However, the next field 404 of region B already stores a pointer to the first child of node 604. Thus, node 608 is added to the hierarchical linked list 620 by storing a pointer to node 608 in both the next field 404 and the skip field 406 of the node descriptor for region D.

The skip field 406 and the next field 404 of the node descriptor 400 for region E both store pointers to the node descriptor for region C. Thus, after nodes for all regions A through E have been added to the hierarchical linked list 620, all nodes in the linked list can be traversed by following the next fields 404 of each node descriptor 400. As shown in FIG. 6, the next field 404 of the node descriptor for region A points to the node descriptor for region B. The next field 404 of the node descriptor for region B points to the node descriptor for region D. The next field 404 of the node descriptor for region D points to the node descriptor for region E. The next field of the node descriptor for region E points to the node descriptor for region C.

Thus, all rectangular regions in the on-screen buffer can be quickly traversed using the hierarchical linked list 620 of nodes to determine the rectangular regions in the on-screen buffer 120. Node 600 is the root node. Node 602 is an interior node and nodes 604, 608 and 606 are leaf nodes. A leaf node is a node in which the skip field 406 and the next field 404 store the same pointer value. Node 604 is a leaf node because both the skip field 406 and the next field 404 store a pointer to node 608. Node 608 is a leaf node because both the skip field 406 and the next field 404 store a pointer to node 606. Node 606 is a leaf node because both the skip field 406 and the next field 404 store the null pointer.

Leaf nodes for a particular root node correspond to the rectangular regions in the on-screen buffer for the root node. As shown in FIG. 3C, leaf nodes 604, 608 and 606 correspond to rectangular regions D, E and C in region A which are uncovered i.e. visible rectangular regions on the screen of the display device 104 and correspond to rectangular regions in the on-screen buffer 120.

Thus, when a command is received to update region A, only rectangular regions D, E and C in region A stored in on-screen buffer are updated. The regions in the on-screen buffer 120 to be updated can be determined easily by traversing the linked list 620 of nodes starting with the node 600 corresponding to region A and comparing the region to be updated with the rectangular regions corresponding to the leaf nodes 604, 606, 608 in the hierarchical linked list 620. Only the rectangular regions corresponding to the leaf nodes in the hierarchical linked list 620 of nodes are stored in the on-screen buffer. After the regions to be updated are identified using the linked list, the regions are updated directly in the on screen buffer 120.

Figure 7B:
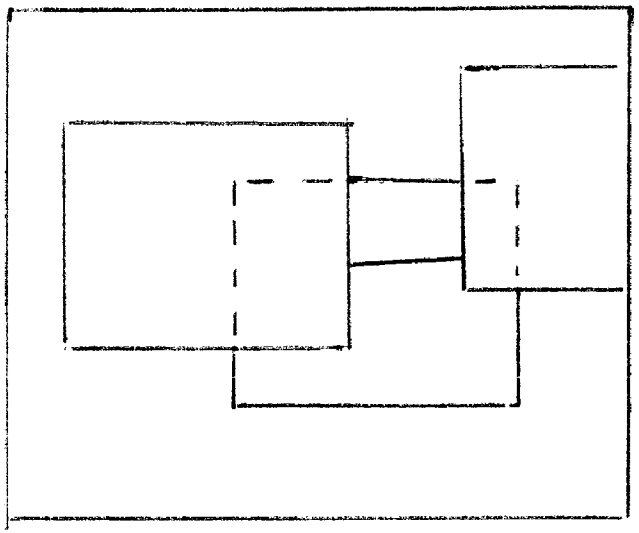
FIGS. 7A and 7B illustrate clipping in the regions defined by the hierarchical linked list shown in FIG. 6.
Figure 7A:
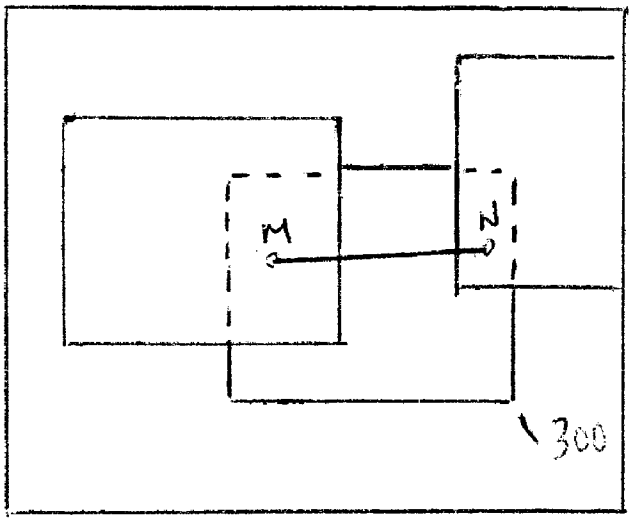

FIGS. 7A and 7B illustrate clipping in the rectangular regions defined by nodes in the hierarchical linked list shown in FIG. 6. As shown in FIG. 7A, an application has issued a graphics command to draw a line from point M to point N in region A.

Referring to FIG. 2, an API command to perform graphics operation in a rectangular region, for example, to draw a line in region A is received by the operating system 116 through the API interface 214 from the application 212. The API command is directed to the graphics subsystem 204 which performs the operations necessary to update the on screen buffer 120 from which the line is displayed by the display device 104.

Returning to FIG. 7A, the line extends over non-visible regions of region A that are not stored in the on screen buffer 120. Prior to updating the on screen buffer 120, the graphics subsystem 204 must compute which portions of the on screen buffer 120 are to be modified in order to display the line by the display device 104, that is, the graphics subsystem 204 clips the line to visible regions of region A. The clipping of the line is computed by the graphics subsystem 204 and the visible regions of region 300 stored in the on screen buffer 120 are updated to add the line.

The clipping of the line is computed using the hierarchical linked list 620 of nodes described in conjunction with FIG. 6. The on screen buffer manager 118 traverses through the hierarchical linked list 620 from node 600 to find the leaf nodes. The leaf nodes are nodes in the linked list in which the skip field 406 and the next field 404 store the same pointer value. The pointer stored can be the null pointer or a pointer to another node in the linked list 620. As previously described, the leaf nodes identify the visible rectangular regions stored in the on screen buffer 120 for the selected rectangular region.

The co-ordinates of the line to be added are compared with the bounds of each of the rectangular regions defined by the region descriptor 402 for each leaf node. For example, an intersect routine can compute the co-ordinates of the line and determine whether the line intersects the bounds of the rectangular region. The line is only drawn in the rectangular regions in which there is an intersection.

Referring to FIG. 7B, the line to be added to region A is clipped to region B because region B is the only region in the on screen buffer that intersects the line. Thus, only region B is updated with the line in the on-screen memory buffer. The regions of the screen to be updated can be quickly identified by traversing the hierarchical linked list 620 of nodes to the leaf nodes representing rectangular regions in the onscreen buffer 120.

Figure 8B:
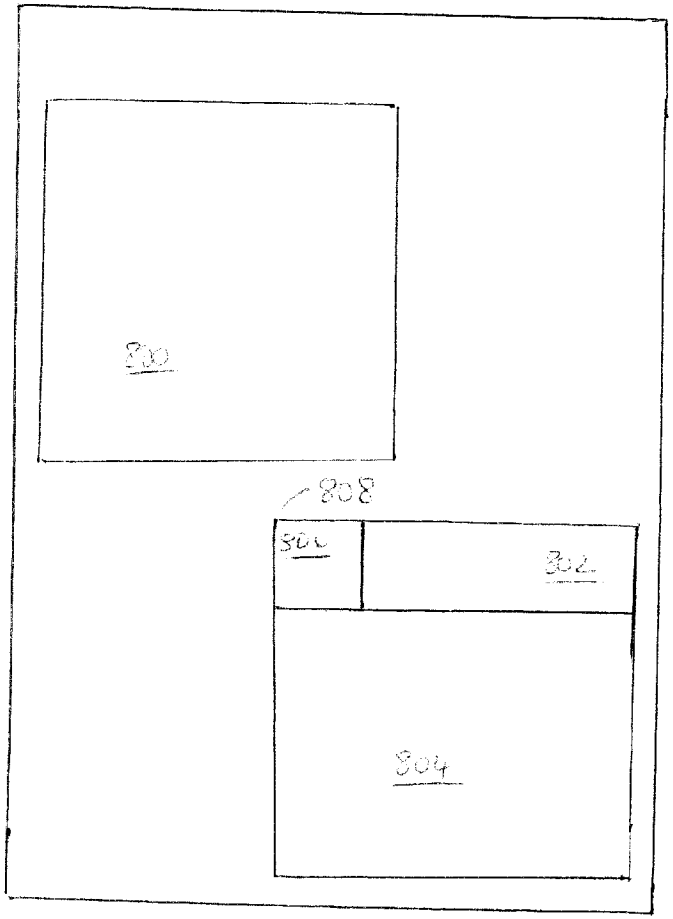
FIGS. 8A and 8B illustrate rectangular regions displayed on a screen of a display device before and after a rectangular region is moved.
Figure 8A:
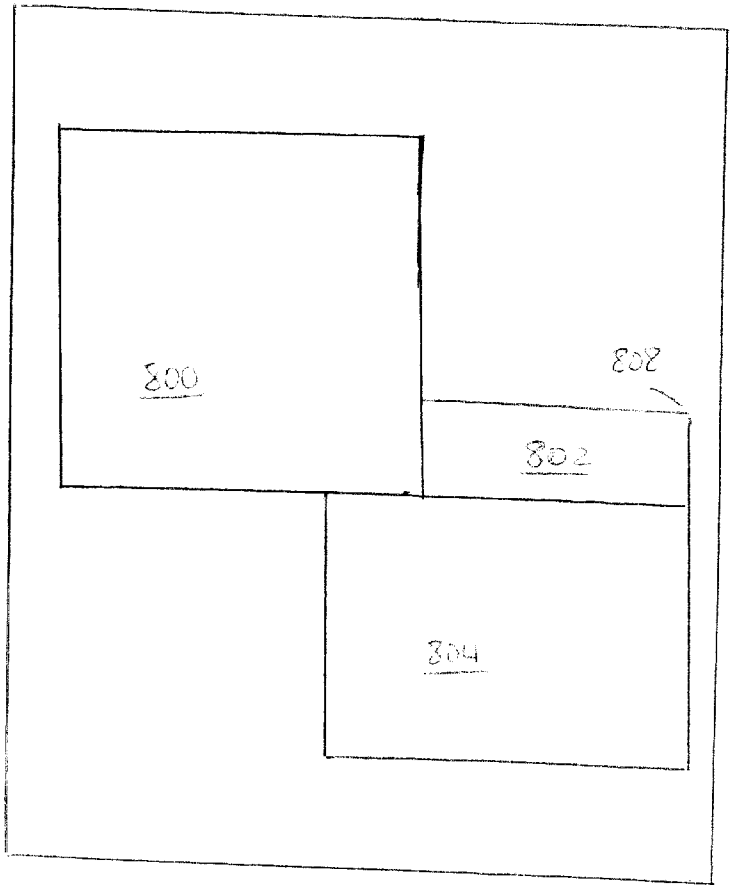

The hierarchical linked list 620 of node descriptors can also be used to efficiently update the on screen buffer 120 after a region is moved. FIGS. 8A and 8B illustrate rectangular regions displayed by a display device interface 104 before and after a rectangular region is moved.

FIG. 8A illustrates three rectangular regions 800, 802, 804 on the screen of the display device 104. Rectangular regions 800, 802 and 804 are represented by leaf nodes in the hierarchical linked list of nodes.

FIG. 8B illustrates rectangular regions after moving rectangular region 800. The moving of rectangular region 800 exposes previously covered rectangular region 806. Rectangular regions 806, 802 and 804 are children of parent rectangular region 808. The update of the on screen buffer 120 required to move rectangular region 800 is performed using two hierarchical linked lists, a source hierarchical linked list and a destination hierarchical linked list.

A list of regions to be updated is computed by a subtraction algorithm which computes regions based on the difference between the x co-ordinates and the y coordinates of the source rectangular region and the x and y coordinates of the destination rectangular regions corresponding to the source nodes.

The subtraction algorithm subtracts each rectangular region co-ordinates in a node in the destination linked list from the respective node in the source linked list. The difference indicates newly uncovered rectangular regions to be repainted after the move. Only the newly uncovered rectangular regions are repainted and added to the destination linked list.

The source hierarchical linked list is a linked list of all node descriptors for rectangular regions shown in FIG. 8A. The destination hierarchical linked list is a linked list of the node descriptors for rectangular regions shown in FIG. 8B.

If the move results in covering a rectangular region in the source, the leaf node in the source linked list is not copied to the destination linked list. If the move results in uncovering a rectangular region, a node is added to the destination linked list with no corresponding node in the source linked list, the region is reported so that data can be written to the uncovered rectangular region in the on screen buffer.

In one embodiment, in order to conserve processing cycles, the destination linked list of nodes is not generated until a request to process a graphics command e.g. draw line instruction is received. The destination linked list of nodes is generated the first time that a request to draw in the rectangular region is received by the graphics subsystem. The foregoing described graphics subsystem uses a single on-screen buffer to perform screen updates in a memory and time efficient manner.

It will be apparent to those of ordinary skill in the art, that methods involved in the present invention may be embodied in a computer program product that includes a computer usable medium. For example, such a computer usable medium can consist of a read only memory device, such as a hard drive or a computer diskette, having computer readable program code stored thereon.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for managing an on screen buffer representing a two-dimensional coordinate space comprising the steps of:

representing the on screen buffer as a hierarchical linked list of nodes, each node representing a rectangular region of the two-dimensional coordinate space, the rectangular region of a parent node acts as a bounding box for all descendant nodes; and determining a region of the on screen buffer to be updated by traversing the hierarchical linked list for nodes representing respective rectangular regions intersecting a desired update area.

2. The method of claim 1 wherein the step of representing includes each node having a respective node identifier stored in a single cache line.

3. The method of claim 2 wherein the node identifier identifies the rectangular region represented by the node and a next node, a skip node, a previous node and a parent node associated with the node in the hierarchical linked list of nodes.

4. The method of claim 1 wherein the rectangular region is a window.

5. A graphics subsystem which manages an on screen buffer representing a two-dimensional coordinate space comprising:

a hierarchical linked list of nodes, each node representing a rectangular region of the two-dimensional coordinate space, the rectangular region of a parent node acts as a bounding box for all descendant nodes; and an on-screen buffer manager which determines a region of the on screen buffer to be updated by traversing the hierarchical linked list for nodes representing respective rectangular regions intersecting a desired update area.

6. The graphics subsystem of claim 5 wherein each node in the hierarchical linked list of nodes has a respective node identifier stored in a single cache line.

7. The graphics subsystem of claim 6 wherein the node identifier identifies the rectangular region represented by the node and a next node, a skip node, a previous node and a parent node associated with the node in the hierarchical linked list of nodes.

8. The graphics subsystem of claim 5 wherein the rectangular region is a window.

9. A graphics subsystem which manages an on screen buffer representing a two-dimensional coordinate space comprising:

a hierarchical linked list of nodes, each node representing a rectangular region of the two-dimensional coordinate space, the rectangular region of a parent node acts as a bounding box for all descendant nodes; and means for determining a region of the on screen buffer to be updated by traversing the hierarchical linked list for nodes representing respective rectangular regions intersecting a desired update area.

10. The graphics subsystem of claim 9 wherein each node in the hierarchical linked list of nodes has a respective node identifier stored in a single cache line.

11. The graphics subsystem of claim 10 wherein the node identifier identifies the rectangular region represented by the node and a next node, a skip node, a previous node and a parent node associated with the node in the hierarchical linked list of nodes.

12. The graphics subsystem of claim 9 wherein the rectangular region is a window.

13. A computer program product, for managing an on screen buffer representing a two-dimensional coordinate space, the computer program product comprising a computer readable medium having computer readable code thereon, including program code which:

represents the on screen buffer as a hierarchical linked list of nodes, each node representing a rectangular region of the two-dimensional coordinate space, the rectangular region of a parent node acts as a bounding box for all descendant nodes; and determines a region of the screen buffer to be updated by traversing the hierarchical linked list for nodes representing respective rectangular regions intersecting a desired update area.

14. The method of claim 1 wherein leaf nodes in the hierarchical linked list of nodes represent visible regions in the on screen buffer.

15. The method of claim 1 further comprising:

storing visible rectangular regions represented by leaf nodes in the hierarchical linked list of nodes in the on screen buffer.

* * * * *